United States Patent [19]

Locke

[11] 4,151,644

[45] May 1, 1979

[54] DEVICE FOR DISLODGING INGROWN FACIAL HAIRS

[75] Inventor: David R. Locke, Bridgeport, Conn.

[73] Assignee: Sperry Rand Corporation, Bridgeport, Conn.

[21] Appl. No.: 885,225

[22] Filed: Mar. 10, 1978

Related U.S. Application Data

[63] Continuation of Ser. No. 748,612, Dec. 6, 1976, abandoned.

[51] Int. Cl.[2] ..... B26B 19/42

[52] U.S. Cl. ..... 30/172

[58] Field of Search ..... 30/34.2, 172

[56] References Cited

FOREIGN PATENT DOCUMENTS 2511960 3/1975 Fed. Rep. of Germany ..... 30/34.2

*Primary Examiner*—Robert C. Watson

*Attorney, Agent, or Firm*—Charles R. Miranda

[57] ABSTRACT

A device for lifting and dislodging ingrown facial or neck hairs from the skin and which device is adapted for use either independently or as incorporated in the cutter head of electric dry shaver. The device includes a plate member formed with raking teeth projecting outwardly of a recessed portion of a hand-held casing or from the outer cutter of a cutter head assembly for traversal across the skin of the user.

9 Claims, 9 Drawing Figures

Fig. 1.
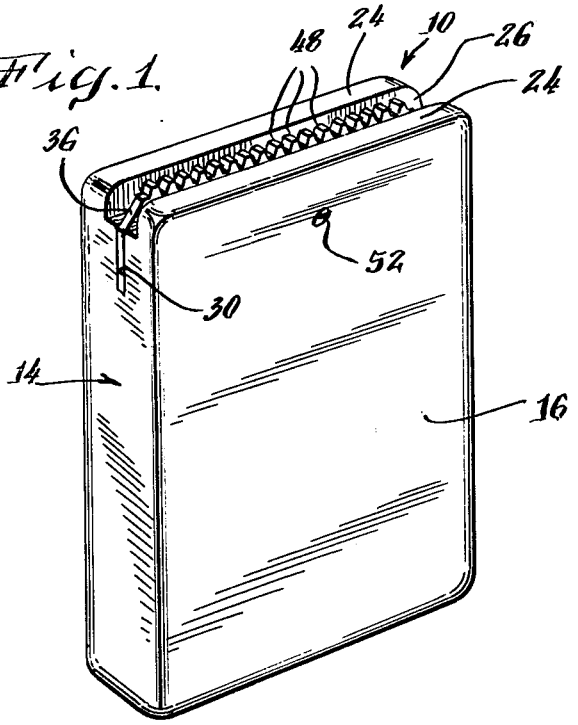
Fig. 5.
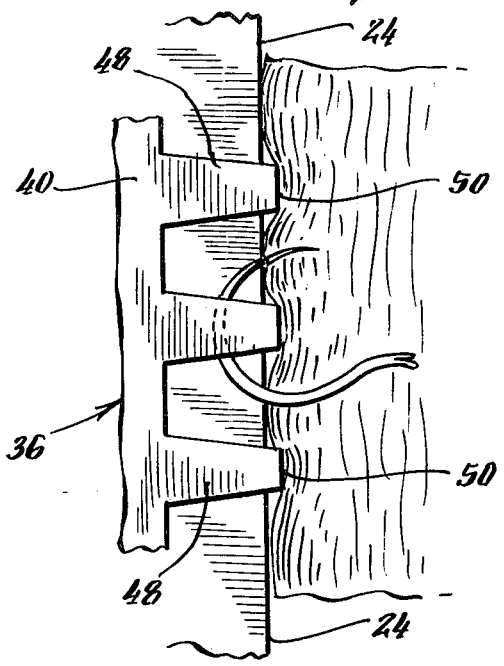
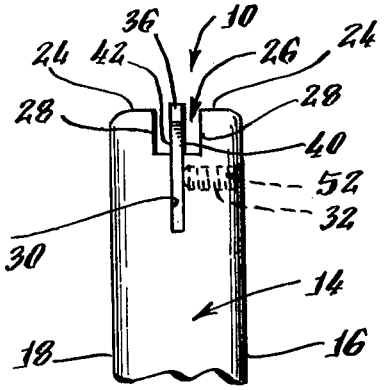
Fig. 2.
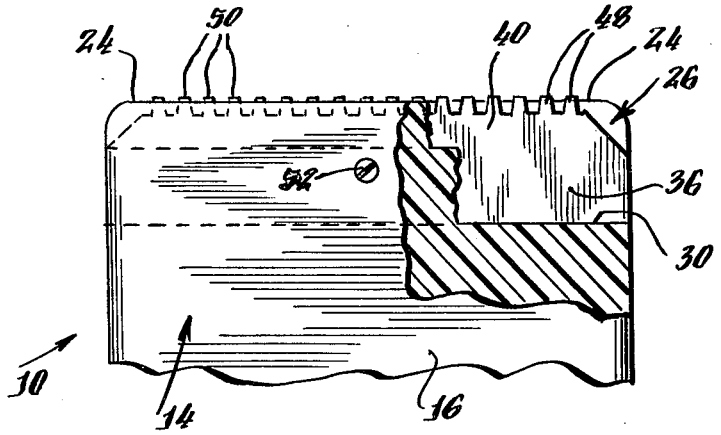
Fig. 3.
Fig. 4.
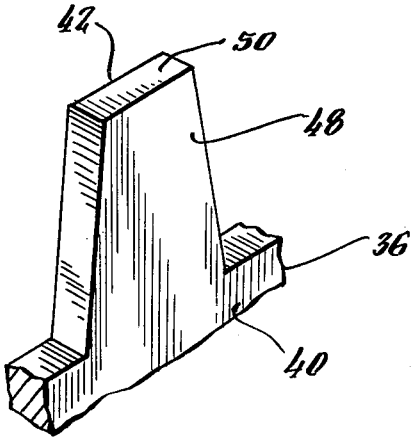

DEVICE FOR DISLODGING INGROWN FACIAL HAIRS

This is a continuation of application Ser. No. 748,612 filed Dec. 6, 1976 now abandoned.

BACKGROUND OF THE INVENTION

This invention is directed to new and useful improvements in shaving systems and in particular in the provision of a device for dislodging ingrown facial hairs either prior to or during the act of shaving.

Persons afflicted with the condition of ingrown facial hairs, which is also known as psuedofolliculitis barbe, encounter severe difficulties in shaving. Ingrown facial hairs of this type are caused by the ends of curved hair bristles reentering the skin surface upon growth of the hair from its skin follicle. During the act of shaving the ends of the curved hair bristles are cut forming a sharp surface for entry of the bristle into the skin. The end once planed forms its own follicle in the skin surface resulting in a papule on the skin surface which often become infected resulting in unsightly appearances on the skin surface. The act of shaving with a razor or electric shaver often increases the problem as the raised skin surfaces caused by the papules are often cut resulting in discomfort to the user and bumps on the skin surface which are sometimes referred to as "razor bumps".

In known shaving devices means are not provided for lifting the ingrown ends of the bristles from the skin of the user. In the past means provided for dislodging and lifting ingrown hairs prior to shaving have included brushing or tweezing devices. These known devices have not only increased the time for an act of shaving but have often lead to increased irritation to the face of the user.

It is an object of the present invention to provide novel means for lifting and dislodging ingrown hairs.

Another object is to provide a novel device for lifting and dislodging ingrown facial hairs from the skin surface dislodge ingrown hairs in the operation of the shaver as the cutter head assembly is moved across the face of the user with the dislodged hairs fed directly to the inner cutter for shaving.

The above and other objects of the present invention will appear more fully hereinafter from a consideration of the detailed description which follows taken together with the accompanying drawings where two embodiments of the invention are illustrated.

DESCRIPTION OF THE DRAWINGS

In the drawings:

FIG. 1 is a perspective view of a hand-held device incorporating the present invention;

FIG. 2 is a fragmentary side elevational view of the upper portion of the device of FIG. 1;

FIG. 3 is a fragmentary front elevational view of the device of FIG. 1 with parts broken away to show the interior thereof;

FIG. 4 is a perspective view of a tooth of the raking device;

FIG. 5 is an enlarged fragmentary view of a portion of the raking device in engagement with an ingrown hair bristle;

DETAILED DESCRIPTION

Figure 6:
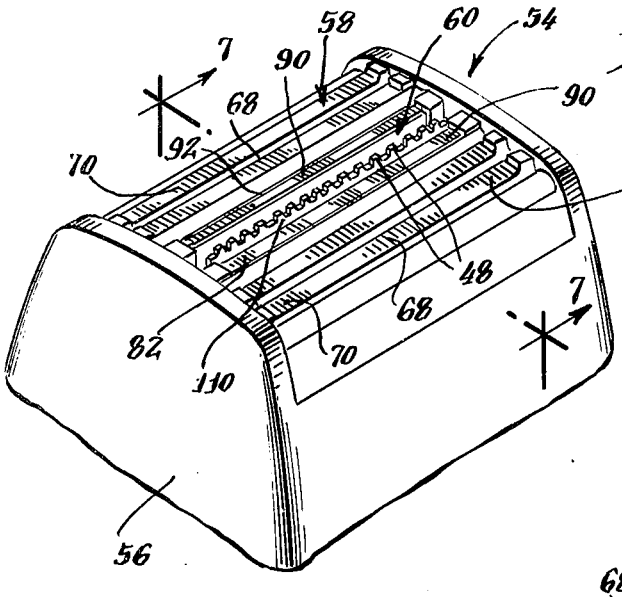
FIG. 6 is a fragmentary perspective view of an upper portion of an electric dry shaver incorporating the raking device within the cutter head assembly thereof.
Figure 7:
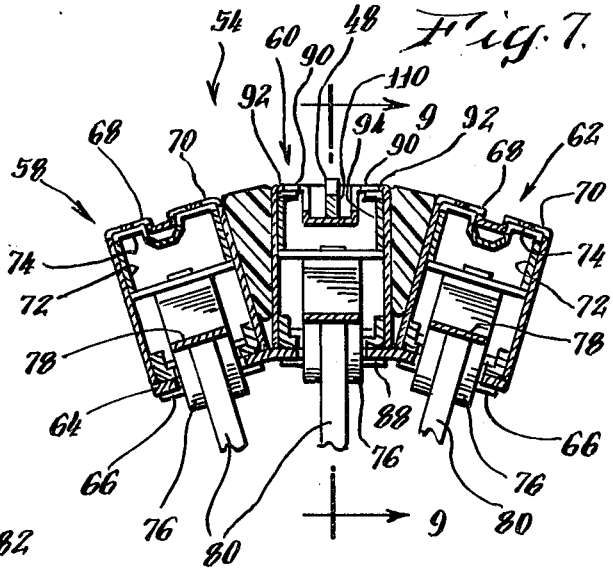
FIG. 7 is a sectional view of the cutter head assembly taken on the line 7—7 of FIG. 6 with the latter assembly moved from the shaver casing.
Figure 8:
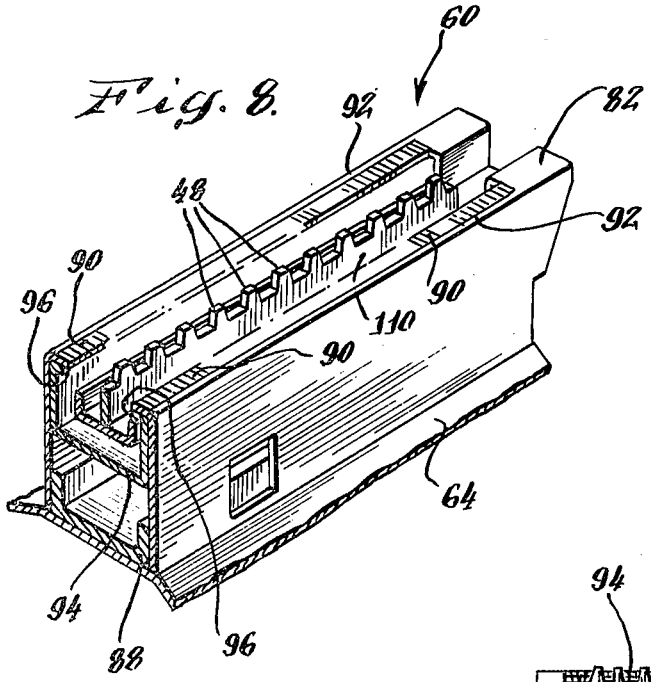
FIG. 8 is a fragmentary perspective view of a cutter unit incorporating the raking device.

Referring now to the drawings for a more detailed description of the present invention, a device incorporating the present invention is generally indicated by the reference numeral 10. In this embodiment, device 10 for lifting and dislodging ingrown hairs includes a hand-held casing or handle comprising an elongated body 14 having opposed faces 16 and 18. The top surface (FIGS. 1 to 3) of device 10 is provided with skin engaging ledge surface 24 at opposite sides of an elongated recess or channel 26 and extends transversely of casing 10. An elongated slot 30 is formed across the bottom of the channel 26. A threaded hole 32 (FIG. 2) is formed in face 16 extending into slot 30.

A novel implement for lifting and dislodging ingrown hairs is provided in device 10 and include a rectangular-shaped plate-like member 36 having opposite side surfaces 40 and 42, an upper marginal portion 46 of plate 36 is provided with a plurality of spaced frusto-rectangular-shaped raking teeth 48 which extend from the body of plate member 36 and terminate in teeth end surfaces 50. The lower marginal portion of plate member 36 is inserted in slot 30 in channel 26 and is secured to the handle 12 by a set-screw 52 threaded in hole 32. With the plate member 36 secured to the body 14 the teeth end surfaces 50 are spaced a predetermined distance above and adjacent the skin engaging ledges 24.

In accordance with the above described structure and as illustrated in FIG. 5, the opposite faces 16–18 of device are grasped in the hand of the user and skin engaging ledges 24 are brought into contact with the skin surface. Due to the predetermined spacing between the teeth and surfaces 50 and the ledges 24 the skin is depressed about teeth 48. The surface areas of the ledges 24 and the teeth end surfaces 50 are of preselected dimensions to limit the amount of the depression of the skin regardless of the amount of pressure applied by the user thereby preventing penetration of rake teeth 48 into the skin of the user. In use as tool 10 is manipulated across the skin of the user to move rake teeth 48 across the skin, the ends of teeth 48 in the locally depressed areas will engage the loop of an embedded ingrown hair. Further movement of device 10 will lift the ingrown end of the hair so engaged free of the papule in which it is embedded. In the dislodged position, the freed hair end may be readily shaven.

As mentioned it is a feature of the present invention to utilize the novel raking means independently, as above described, or as incorporated into the cutter head assembly of an electric dry shaver. To this end as shown in FIGS. 6 to 9 the novel raking device is included in the cutter head assembly 54 of an electric dry shaver 56.

Figure 9:
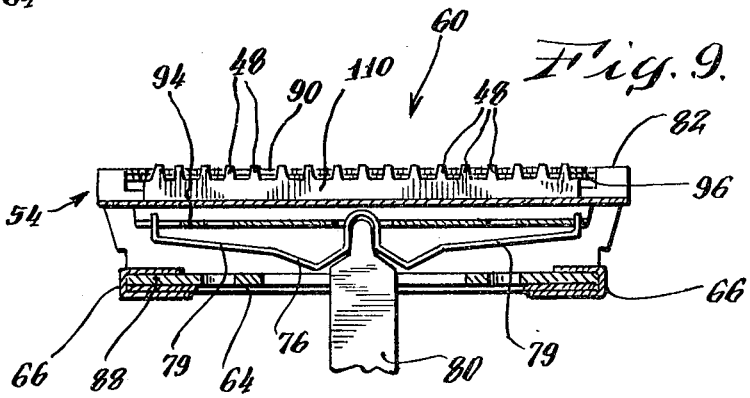
FIG. 9 is a sectional view taken from the line 9—9 of FIG. 7.

Cutter head assembly 52 includes individual cutter head units 58, 60, and 62 mounted on a support plate 64 in a known manner such as by clamps 66 (FIG. 9). Cutter units 58 and 62 are adapted for shaving short hair bristles and each include an elongated outer cutter 68 provided with transverse hair reception slots 70. A movable inner cutter 72 having transverse cutter teeth 74 in shearing engagement with the edges of slots 70 is mounted in each outer cutter 68. Inner cutters 72 are held in engagement with the under surface of outer cutters 68 by means of leaf springs 76. Each spring 76 has a central driving portion 78 for engagement in a known manner with an oscillator arm 80 connected to the shaver motor (not shown) also in a well-known manner of engagement for reciprocating inner cutter 72.

Central cutter unit 60 of cutter head 52 of a type generally disclosed in U.S. Pat. No. 4,081,902 issued Apr. 4, 1978, for cutting long facial hair. Central cutter unit 60 is provided with an elongated stationary outer cutter 82 secured to the walls of a U-shaped base spacer 88. The bite portion of stationary cutter 82 is provided with spaced rows of opposed combing teeth 90. The rows of combing teeth 90 extend toward each other from flat ledges 92 on the same plane as the combing teeth 90. The rows of combing teeth 90 are spaced one from the other by a deep longitudinally extending channel 84 having a base or bottom wall 86 and is formed integral with the bite portion of stationary cutter 82 at opposed distal ends thereof. The base member 86 is otherwise spaced from combing teeth 90 by longitudinally extending wall portions 87 provided with hair reception openings 89 along the length thereof within the longitudinal channel 84. The base member 86 serves to strengthen stationary cutter 82 by tying the spaced rows of combing teeth 90 one to the other.

A movable cutter 94 is provided for stationary cutter 82 having cutter teeth 96. Teeth 96 are maintained in cutting communication with the undersurface of combing teeth 90 of stationary cutter 82 by leaf spring 76 having arms 79 interconnected to the ends of movable cutter 94 in a known manner to urge movable cutter 94 into shearing relationship with combing teeth 90 when central portion 78 of leaf spring 76 is seated on motor drive arm 80 for reciprocation in unison with inner cutters 72 of cutter units 58 and 62.

In accordance with the present invention a raking device for dislodging ingrown hair is provided in cutter unit 60 and comprises an elongated rake member 110 secured to the bottom wall 86 of channel 84 by any suitable attachment means such as, but not limited to welding. Raking teeth 48 are provided across the upper edge of rake member 110 and project beyond or above the plane of the upper surface of stationary cutter 82 from within the central opening thereof.

In operation of shaver 56 therefore, as cutter head assembly 52 is moved across the face of the user, rake teeth 48 will engage and dislodge embedded ingrown hairs in the manner described with respect to hand-held device 10. As the hair is dislodged from the skin surface by the frusto-triangular shaped teeth 48 it is fed directly into engagement with the combing teeth 90 and into the path of teeth 96 of movable cutter 94 for shearing.

It will be apparent from the foregoing description that the novel device has many advantages in use. One advantage is that simple and efficient means are provided for lifting and dislodging embedded ingrown hairs from the skin of the user with a minimum of irritation and effort. In addition the device may be readily incorporated into the head of an electric dry shaver for use therewith without materially increasing the cost thereof either in assembly or other manufacturing costs.

It is expressly understood that the present invention is not limited to the embodiments illustrated and described. Various changes can be made in the design and arrangement of parts without departing from the spirit and scope of the same as will now be understood by those skilled in the art.

What is claimed is:

1. A manually operable tool for manipulation across a person's skin for dislodging ingrown hairs therefrom, said tool comprising;

a. a handle member, b. a pair of spaced ledges formed on said handle member having coplanar surfaces, c. a pluarlity of stationary teeth arranged on said handle member between said spaced ledges, said teeth extending outwardly of said coplanar surfaces and terminating in end surfaces, d. means for locally depressing an area of skin about each of said end surfaces including said end surfaces being formed coplanar with respect to each other and arranged on a plane spaced a predetermined distance from and above the coplanar surfaces of said ledges, e. means for limiting the amount of depression of the skin in said locally depressed areas regardless of the amount of pressure applied thereto including forming said coplanar surfaces of the ledges and of said end surfaces of the teeth with areas thereof of preselected dimensions to prevent penetration of the skin by said teeth, and f. said handle member including means for adjusting the spacing of said predetermined distance of said coplanar end surfaces of the teeth with respect to said coplanar surfaces of the ledges.

2. The tool of claim 1 wherein said adjusting means include a channel formed in said handle member between said ledges, a plate member having said end surfaces of the teeth formed thereon and arranged in said channel, and a fastener member positioned in said handle member in communication with said channel for securing said plate member in said channel to selectively space the plane of said end surfaces a predetermined position above said coplanar surfaces of the ledges.

3. A manually operable tool for manipulation across a person's skin for engaging and dislodging embedded ingrown hairs therefrom, said tool comprising;

a. a handle member having a pair of spaced skin engaging ledges formed thereon, b. a plurality of stationary teeth arranged on said handle member between said ledges, said teeth extending outwardly of said ledges and terminating in tooth ends, said teeth and said tooth ends and said ledges having a predetermined spacing therebetween for locally depressing an area of skin about each of said teeth;

c. means formed on said teeth adjacent said tooth ends for engaging a loop of imbedded ingrown hair in said locally depressed areas of the skin; and d. means formed on said ledges and said tooth ends for limiting the amount of depression on said areas of the skin regardless of the amount of pressure applied thereto.

4. The tool of claim 3 wherein said loop engaging means include opposite side surfaces of said teeth; and said skin depression limiting means include planar surfaces of preselected dimensions on said ledges and said tooth ends, said planar surfaces on the ledges formed parallel to said planar surfaces on the tooth ends.

5. The tool of claim 4 wherein said skin engaging ledges are provided at opposite sides of an elongated recess formed in said handle member, and said teeth are arranged in said recess in an aligned row of teeth.

6. The tool of claim 5 wherein said recess portion is an elongated open ended channel extending through said handle member parallel to said aligned row of teeth, said channel having a bottom wall and opposed sidewalls, said opposite side surfaces of the teeth extending from the end surfaces of the teeth to said bottom wall, parallel to said sidewalls.

7. A manually operable tool for manipulation across a person's skin for engaging and dislodging embedded ingrown hairs therefrom, said tool comprising;

a. a handle member, b. a skin engaging ledge arranged on said handle member, c. a pluarlity of stationary teeth arranged on said handle member adjacent said ledge, said teeth extending outwardly of said ledge and terminating in tooth ends, said teeth and said tooth ends and said ledge having a predetermined spacing therebetween for locally depressing an area of skin about each of said teeth, d. means formed on said teeth adjacent said tooth ends for engaging a loop of imbedded ingrown hair in said locally depressed areas of the skin; and e. means formed on said ledge and said tooth ends for limiting the amount of depression on said areas of the skin regardless of the amount of pressure applied thereto.

8. The tool of claim 7 wherein said loop engaging means include opposite side surfaces of said teeth; and said skin depression limiting means include planar surfaces of preselected dimensions on said ledge and said tooth ends, said planar surfaces on the ledge formed parallel to said planar surfaces on the tooth ends.

9. The tool of claim 8 wherein said predetermined spacing includes positioning said tooth ends a predetermined distance outwardly of said ledge; and said handle member includes means for adjusting said predetermined distance of said tooth ends relative to said ledge.

* * * * *